US005752456A

United States Patent [19]

Nishizawa et al.

[11] Patent Number: 5,752,456

[45] Date of Patent: May 19, 1998

[54] EYELET-END BUTTONHOLE SEWING MACHINE WHEREIN TACKING DATA FOR BAR TACK ARE GENERATED BASED ON OPERATOR-SPECIFIED CHARACTERISTICS OF THE BAR TACK

[75] Inventors: Yoshifumi Nishizawa, Tokyo; Jun Gamano, Okazaki; Hideo Ando, Konan; Akihiro Funahashi, Handa, all of Japan

[73] Assignees: Mitsubishi Denki Kabushiki Kaisha, Tokyo; Brother Kogyo Kabushiki Kaisha, Nagoya, both of Japan

[21] Appl. No.: 747,384

[22] Filed: Nov. 12, 1996

[30] Foreign Application Priority Data

Nov. 15, 1995 [JP] Japan ..... 7-322247

[51] Int. Cl.[6] ..... D05B 21/00; D05B 3/08

[52] U.S. Cl. ..... 112/70; 112/470.04; 112/470.06; 112/447

[58] Field of Search ..... 112/447, 446, 112/316, 317, 475.25, 65, 70, 470.04, 470.06

[56] References Cited

U.S. PATENT DOCUMENTS 4,495,878 1/1985 Asai et al. .
4,502,401 3/1985 Asai et al. .
4,648,340 3/1987 Hanyu et al. ..... 112/447
4,696,245 9/1987 Kato et al. ..... 112/447 X

FOREIGN PATENT DOCUMENTS

A-4-261694 9/1992 Japan .
A-4-261695 9/1992 Japan .

*Primary Examiner*—Peter Nerbun
*Attorney, Agent, or Firm*—Oliff & Berridge, PLC

[57] ABSTRACT

A buttonhole sewing machine including stitching instrumentalities for forming zigzag stitches defining an eyelet-end buttonhole having an eyelet end portion at one end of a foot portion, by operations of a driving mechanism for operating needle and looper device of the stitching instrumentalities, a feeding mechanism for feeding work fabric feeding table along X and Y axes, and a rotating mechanism for rotating needle bar and looper base about an axis perpendicular to the X and Y axes, according to primary stitching data, and wherein a data input device is provided for operation by an operator to specify at least one characteristic of a bar tack portion to be formed at the other end of the foot portion of the eyelet-end buttonhole, and a data generating device is provided for generating tacking data as secondary stitching data on the basis of the specified characteristic or characteristics, to stitch the bar tack portion.

14 Claims, 7 Drawing Sheets

FIG. 4

37a

| | STITCHES | X-AXIS MOTOR STEPS | Y-AXIS MOTOR STEPS | θ-AXIS MOTOR STEPS |
|---|---|---|---|---|
| FR | 1N <1> → (1) | 0 | 0 | 0 |
| | 2N <2> → (2) | 0 | 20 | 0 |
| | 3N <3> → (3) | 0 | 20 | 0 |
| | 4N <4> → (4) | 0 | 20 | 0 |
| | 5N <5> → (5) | 0 | 20 | 0 |
| DE | 6N <6> → (6) | 8 | 20 | 0 |
| | 7N <7> → (7) | 8 | 20 | 0 |
| | 8N <8> → (8) | −5 | 10 | 45 |
| | 9N <9> → (9) | −12 | 5 | 45 |
| | 10N <10> → (10) | −12 | −5 | 45 |
| | 11N <11> → (11) | −5 | −10 | 45 |
| | 12N <12> → (12) | 8 | −20 | 0 |
| | 13N <13> → (13) | 8 | −20 | 0 |
| FL | 14N <14> → (14) | 0 | −20 | 0 |
| | 15N <15> → (15) | 0 | −20 | 0 |
| | 16N <16> → (16) | 0 | −20 | 0 |
| | 17N <17> → (17) | 0 | −20 | 0 |
| | <17> → (18) | 0 | 0 | 0 |

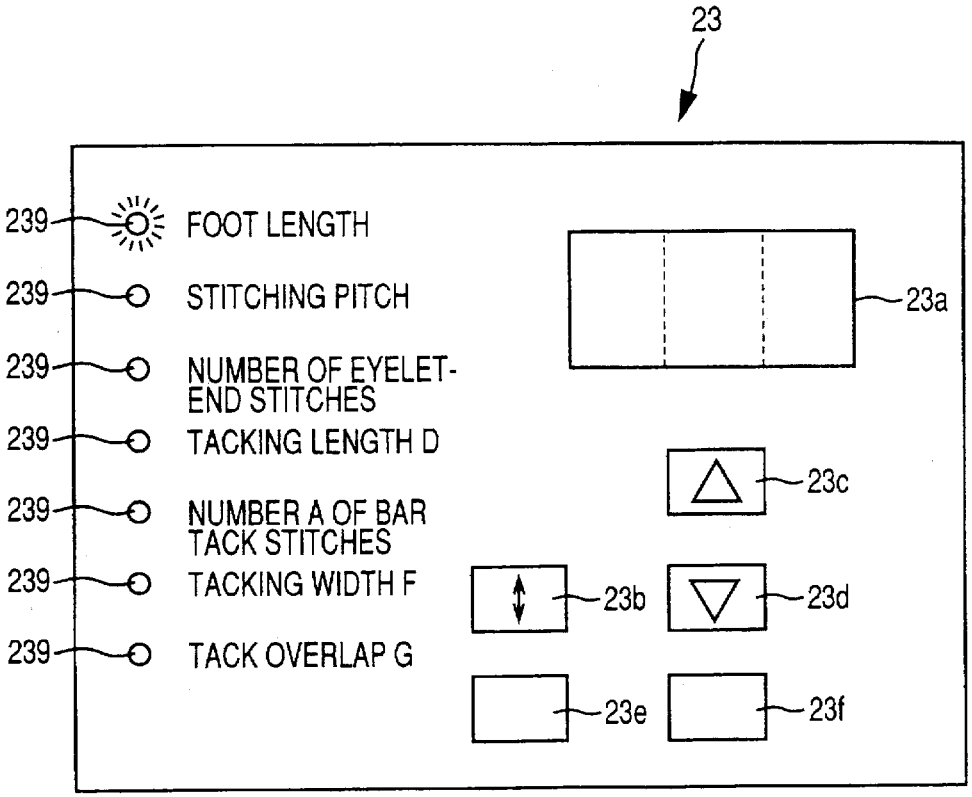
FIG. 6
FIG. 7
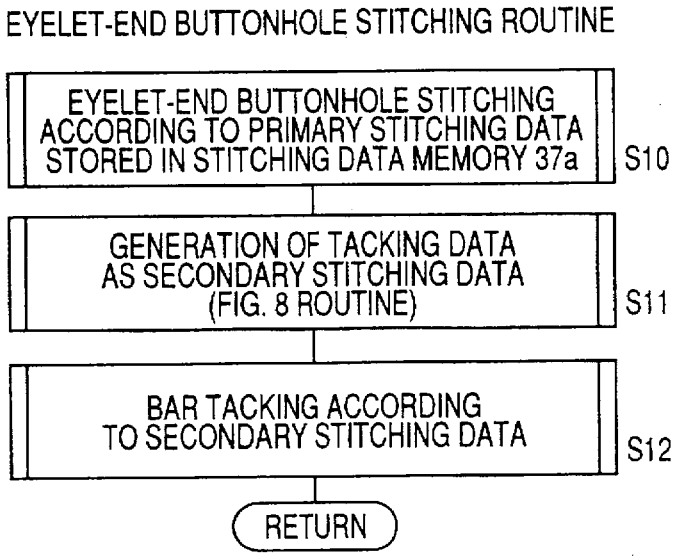

38a

| STITCH NO. | STITCHING POSITIONS | X-AXIS MOTOR STEPS | Y-AXIS MOTOR STEPS | θ-AXIS MOTOR STEPS |
|---|---|---|---|---|
| 1ST | <18> → a | −(D/2)/p1 | (L−(F−G))/p2 | 90°/p3 |
| | a → b | 0 | (F−L)/p2 | 0 |
| 2ND | b → c | (D/(A−1))/p1 | −(F−L)/p2 | 0 |
| | c → d | 0 | (F−L)/p2 | 0 |
| (A−2)TH TO A-TH | ⋮ | ⋮ | ⋮ | ⋮ |
| | t → u | (D/(A−1))/p1 | −(F−L)/p2 | 0 |
| | u → E | 0 | (F−L)/p2 | 0 |

EYELET-END BUTTONHOLE SEWING MACHINE WHEREIN TACKING DATA FOR BAR TACK ARE GENERATED BASED ON OPERATOR-SPECIFIED CHARACTERISTICS OF THE BAR TACK

BACKGROUND OF THE INVENTION

1. Field of the Invention

The present invention relates in general to a sewing machine for stitching an eyelet-end buttonhole (keyhole type buttonhole) having a foot portion, an eyelet-end portion at one end of the foot portion and a bar tack portion at the other end of the foot portion. More particularly, the present invention is concerned with techniques for generating tacking data for stitching the bar tack portion of the eyelet-end buttonhole, continuously with the stitching of the foot portion and the eyelet-end portion.

2. Discussion of the Related Art

JP-A-4-261694 and JP-A-4-261695 show examples of such a buttonhole sewing machine capable of stitching an eyelet-end buttonhole including a foot portion and an eyelet-end portion formed continuously with the foot portion at one end of the foot portion. The foot portion consists of a pair of parallel side stitching parts which are spaced apart from each other by a suitable small distance in a direction perpendicular to the direction of extension of the foot portion from the eyelet-end portion. The two parallel side stitching parts are connected at their ends by the eyelet-end portion.

Such an eyelet-end buttonhole sewing machine is provided with stitch-forming instrumentalities for forming zigzag stitches on a work fabric. Each zigzag stitch connects an inner stitching position and an outer stitching position. The stitch-forming instrumentalities include a vertically reciprocable needle bar, a sewing needle vertically reciprocated by the needle bar, and a looper base which incorporates loopers. The buttonhole sewing machine is further provided with a driving mechanism for operating the sewing needle and the loopers in synchronization with each other, to form the zigzag stitches, and a feeding table which is moved with the work fabric in a Y-axis direction parallel to the direction of extension of the foot portion of the eyelet-end buttonhole and in an X-axis direction perpendicular to the Y-axis direction. The buttonhole sewing machine further has a feeding mechanism for feeding the feeding table in the Y-axis and X-axis directions, and a rotating mechanism for rotating the needle bar and the looper base about a third axis perpendicular to the X- and Y-axis directions. The buttonhole sewing machine uses a control device for controlling the driving mechanism, feeding mechanism and rotating mechanism according to stitching data, to first stitch the right side stitching part of the linear foot portion of the eyelet-end buttonhole, then stitch the eyelet-end portion, and finally stitch the left side stitching part of the foot portion, whereby the desired eyelet-end buttonhole is stitched on the work fabric.

Some eyelet-end buttonholes have a bar tack portion at the other end of the foot portion, namely, at the end of the foot portion remote from the eyelet end portion, so that the stitches in the end portion of the foot portion are reinforced by bar tack stitches, as known in the art. The buttonhole sewing machine indicated above, however, is designed exclusively for stitching the foot portion and the eyelet end portion of the eyelet-end buttonhole, and is not capable of forming stitches in the bar tack portion. Therefore, the work fabric on which the foot and eyelet end portions have been stitched by the buttonhole sewing machine should be transferred to a bar tacking sewing machine so that a desired bar tack is formed at the end of the foot portion remote from the eyelet end portion.

Thus, the known eyelet-end buttonhole sewing machine suffers from incapability to stitch the bar tack portion of the eyelet-end buttonhole. To stitch the bar tack portion, the work fabric which has been sewn to stitch the foot portion and the eyelet end portion of the buttonhole should be moved to an exclusive bar tacking sewing machine. Therefore, the eyelet-end buttonhole cannot be stitched with the bar tack in one stitching process, namely, must be stitched in two stitching processes on two sewing machines, leading to relatively low sewing efficiency in stitching the eyelet-end buttonhole having a bar tack portion at the end of the foot portion remote from the eyelet end portion.

U.S. Pat. Nos. 4,495,878 and 4,502,401 to Asai et al. disclose electronic sewing machines capable of stitching an eyelet-end buttonhole with a bar tack. Stitching data including tacking data for stitching the bar tacking portion of the eyelet-end buttonhole are stored in a read-only memory, and the tacking data cannot be changed by the operator, depending upon the desired characteristics of the bar tack portion.

SUMMARY OF THE INVENTION

It is therefore a first object of the present invention to provide a buttonhole sewing machine capable of generating tacking data on the basis of desired characteristics of a bar tack portion of an eyelet-end buttonhole specified by the operator, and stitching the bar tack portion according to the generated tacking data, continuously with the stitching of the foot portion and the eyelet end portion of the buttonhole.

It is a second object of the present invention to provide a recording medium which is accessible by a computer of a sewing machine and which stores a tacking data generating program for generating tacking data on the basis of desired characteristics of a bar tack portion of an eyelet-end buttonhole specified by the operator.

The first object indicated above may be achieved according to a first aspect of the present invention, which provides a buttonhole sewing machine for forming on a work fabric zigzag stitches defining an eyelet-end buttonhole including a foot portion and an eyelet end portion formed at one end of the foot portion, each of the zigzag stitches connecting an inner stitching position and an outer stitching position, the buttonhole sewing machine comprising: (a) stitch-forming instrumentalities including a sewing needle attached to a needle bar and, a looper device disposed in a looper base, the needle and the looper device cooperating to form the zigzag stitches; (b) a driving mechanism for operating the sewing needle and the looper device in synchronization with each other, to form the zigzag stitches successively; (c) a feeding table movable with the work fabric in mutually perpendicular X-axis and Y-axis directions; (d) a feeding mechanism for feeding the feeding table in the Y-axis and X-axis directions independently, when the sewing needle is placed above the work fabric; (d) a rotating mechanism for rotating the needle bar and the looper base about a θ axis intersecting the X- and Y-axis directions; (e) a control device for controlling the driving mechanism, the feeding mechanism and the rotating mechanism, according to primary stitching data representative of a feeding movement of the feeding table and a rotating movement of the needle bar and the looper base for each of the zigzag stitches in the foot portion and the eyelet-end portion of the eyelet-end buttonhole; (f) a data input device operable by an operator of the buttonhole sewing machine to specify at least one characteristic of a bar tack portion to be formed at the other end of the foot portion; and (g) a data generating device for generating tacking data as secondary stitching data on the basis of the at least one characteristic specified through the data input device, the tacking data being used to stitch the bar tack portion.

In the buttonhole sewing machine of the present invention constructed as described above, the desired characteristic or characteristics of the bar tack portion to be formed at the end of the foot portion remote from the eyelet end portion is/are specified by the operator through the data input device. In response to the specified at least one characteristic of the bar tack portion, the data generating device is operated to generate the tacking data or secondary stitching data for stitching the bar tack portion. In this buttonhole sewing machine, the driving mechanism, feeding mechanism and rotating mechanism are controlled by the control device, according to primary stitching data for stitching the foot portion and eyelet end portion of the eyelet-end buttonhole, and the generated tacking data for stitching the bar tack portion, whereby all portions of the eyelet-end buttonhole can be stitched continuously in one sewing process.

Thus, the tacking data for the bar tack can be automatically generated, with the operator simply specifying the characteristic or characteristics of the bar tack portion through the data input device, so that the bar tack portion may be stitched after or before the stitching of the foot and eyelet end portions of the buttonhole, in one stitch process, and the overall buttonhole stitching efficiency is significantly improved.

In one preferred form of the buttonhole sewing machine, the control device includes primary control means for controlling the driving, feeding and rotating mechanisms according to the primary stitching data, to stitch the foot and eyelet-end portions, and secondary control means for controlling the driving, feeding and rotating mechanisms according to the secondary stitching data, to stitch the bar tack portion.

In another preferred form of the invention, the data generating device generates the tacking data such that the bar tack portion is stitched in a direction substantially perpendicular to a direction of stitching of the foot portion.

In a further preferred form of the invention, the buttonhole sewing machine further comprises: (h) a primary stitching data memory storing a plurality of sets of the primary stitching data representative of respective different eyelet-end buttonholes; (i) a characteristic data memory storing a plurality of sets of characteristic data indicative of respective candidate values of each characteristic of the bar tack portion; (j) selecting means for selecting one of the sets of the primary stitching data, to stitch a corresponding one of the eyelet-end buttonholes; and (k) candidate determining means for determining one of the candidate values on the basis of the set of characteristic data selected by the selecting means, as a candidate of the characteristic of the bar tack portion suitable for the eyelet-end buttonhole to be stitched.

In the above form of the sewing machine, the candidate value of the appropriate characteristic of the bar tack portion is automatically determined depending upon the selected set of primary stitching data, that is, depending upon the specific configuration of the foot and eyelet end portion of the buttonhole. Accordingly, the operator may easily specify the characteristic or characteristics of the bar tack portion while observing the determined candidate characteristic value. The operator may use the determined candidate characteristic value as the specified characteristic. In this case, the generation of the tacking data is substantially fully automated.

In one advantageous arrangement of the above preferred form of the invention, the buttonhole sewing machine further comprises a display for indicating the candidate values determined by the candidate determining means, and changing means for permitting the operator to change the candidate value indicated on the display.

In another advantageous arrangement of the same preferred form of the invention, the buttonhole sewing machine further comprises cancelling means for cancelling the candidate value determined by the candidate determining means. The cancelling means may be used when the operator wishes to form a bar tack portion which is considerably different in size from a bar tack portion which is formed according to the candidate values. The cancelling means may be used to stitch the eyelet-end buttonhole without the bar tack portion. In this case, the cancelling means is activated prior to the buttonhole stitching operation, or after the buttonhole stitching operation is interrupted after formation of the foot portion and the eyelet end portion.

In a still further preferred form of the buttonhole sewing machine, the above-indicated at least one characteristic of the bar tack portion of the eyelet-end buttonhole includes at least one of: a length of the bar tack portion in the Y-axis direction; number of stitches in the bar tack portion; a width of the bar tack portion in the X-axis direction; and an amount of overlap in the Y-axis direction of the bar tack portion with respect to the foot portion. In this form of the machine, the operator may specify at least one of the four characteristic values of the bar tack portion through the data input device. The data input device is preferably adapted to specify at least two of the above four characteristic values, and more preferably adapted to specify any and all of the four characteristic values.

In a yet further preferred form of the buttonhole sewing machine, the data input device includes: a display capable of displaying a numerical value; value changing means operable by an operator of the buttonhole sewing machine, for changing the numerical value displayed on the display; and a setting member operable by the operator to specify the numerical value displayed on the display, as the appropriate characteristic of the bar tack portion. In this case, the numerical value entered by the operator is displayed on the display, and can be changed by the operator by manipulating the value changing means. The numerical value displayed can be specified as the characteristic value of the bar tack portion by operating the setting member when the numerical value is displayed on the display.

The second object indicated above may be achieved according to a second aspect of the present invention, which provides a recording medium accessible by a computer of a sewing machine for forming on a work fabric zigzag stitches defining an eyelet-end buttonhole including a foot portion and an eyelet end portion at one end of said foot portion, each of said zigzag stitches connecting an inner stitching position and an outer stitching position, the recording medium storing a tacking data generating program for generating tacking data usable by the sewing machine for forming zigzag stitches in a bar tack portion of the eyelet-end buttonhole such that the bar tack portion is located at the other end of the foot portion, the tacking data generating program being formulated to generate the tacking data on the basis of at least one characteristic specified by an operator of the sewing machine.

When the sewing machine is provided with the recording medium described above, the tacking data for the bar tack portion are automatically generated by the computer according to the tacking data generating program stored in the recording medium, whereby the desired bar tack portion may be formed at the end of the foot portion of the eyelet-end buttonhole remote from the eyelet end portion, by simply specifying desired characteristic or characteristics of the tar tack portion through a data input device provided on the sewing machine.

The second object may also be achieved according to a third aspect of the invention, which provides a recording medium accessible by a computer of a sewing machine for forming on a work fabric zigzag stitches defining an eyelet-end buttonhole including a foot portion and an eyelet end portion at one end of the foot portion, each of the zigzag stitches connecting an inner stitching position and an outer stitching position, the recording medium storing: a tacking data generating program for generating tacking data usable by the sewing machine for forming zigzag stitches in a bar tack portion of the eyelet-end buttonhole such that the bar tack portion is located at the other end of the foot portion, the tacking data generating program being formulated to generate the tacking data on the basis of at least one characteristic of the bar tack portion specified by an operator of the sewing machine; and a buttonhole stitching control program executed by the computer for operating the sewing machine to form the zigzag stitches in the bar tack portion, according to the tacking data generated according to the tacking data generating program.

This recording medium according to the third aspect of the invention provides substantially the same advantages of the recording medium according to the second aspect of the invention described above.

The recording medium according to the third aspect of the invention may further store a characteristic data processing program executed by the computer for processing characteristic data which are entered through a data input device by the operator and which represent the at least one characteristic of the bar tack portion, so that the tacking data are generated according to the tacking data generating program and the characteristic data processed according to the characteristic data processing program.

The present invention also provides a recording medium which stores a specific tacking data generating program for use with various specific forms of buttonhole sewing machine constructed as described above to achieve the first object of the invention.

BRIEF DESCRIPTION OF THE DRAWINGS

The above and optional objects, features, advantages and industrial and technical significance of the present invention will be better understood by reading the following detailed description of a presently preferred embodiment of the invention, when considered in connection with the accompanying drawings, in which:

FIG. 4 is a view for explaining primary stitching data for stitching a foot portion and an eyelet end portion of an eyelet-end buttonhole in the sewing machine;

FIG. 6 is a plan view of an operation control panel of the sewing machine;

FIG. 7 is a flow chart illustrating a buttonhole stitching routine executed according to a buttonhole stitching control program stored in a read-only memory of the control system of FIG. 3;

DESCRIPTION OF THE PREFERRED EMBODIMENTS

Figure 1:
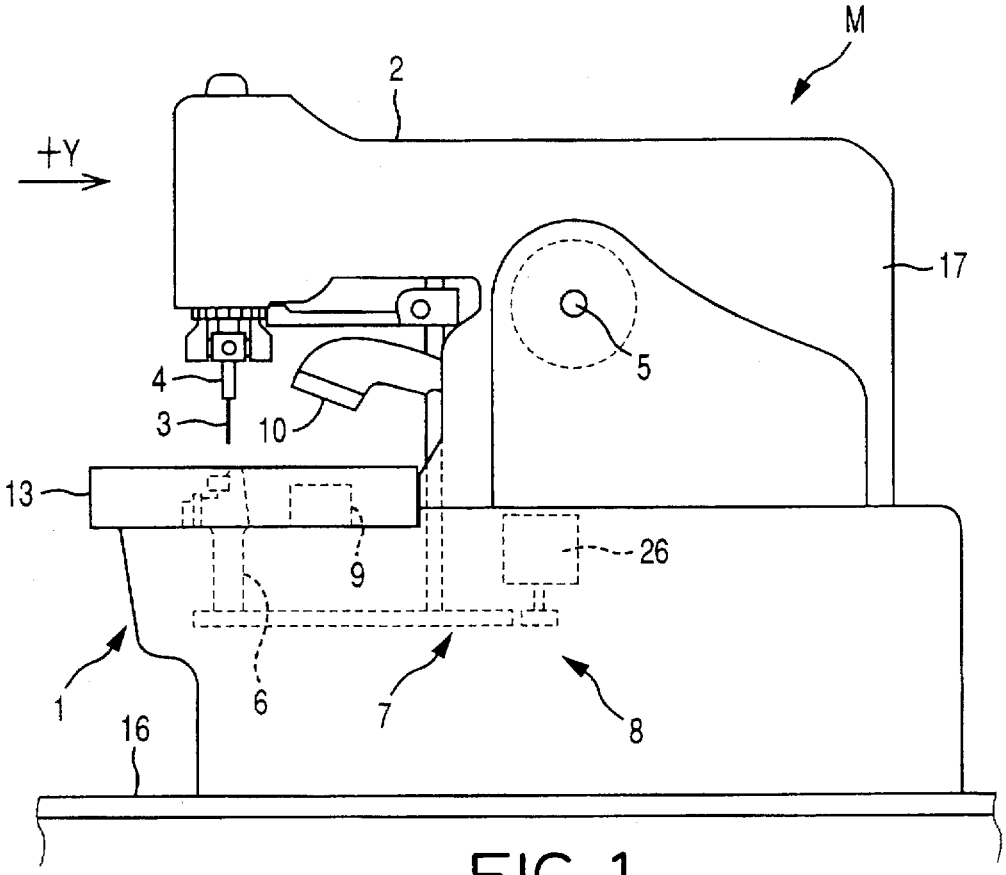
FIG. 1 is a side elevational view of an eyelet-end buttonhole sewing machine constructed according to one embodiment of this invention.
Figure 5:
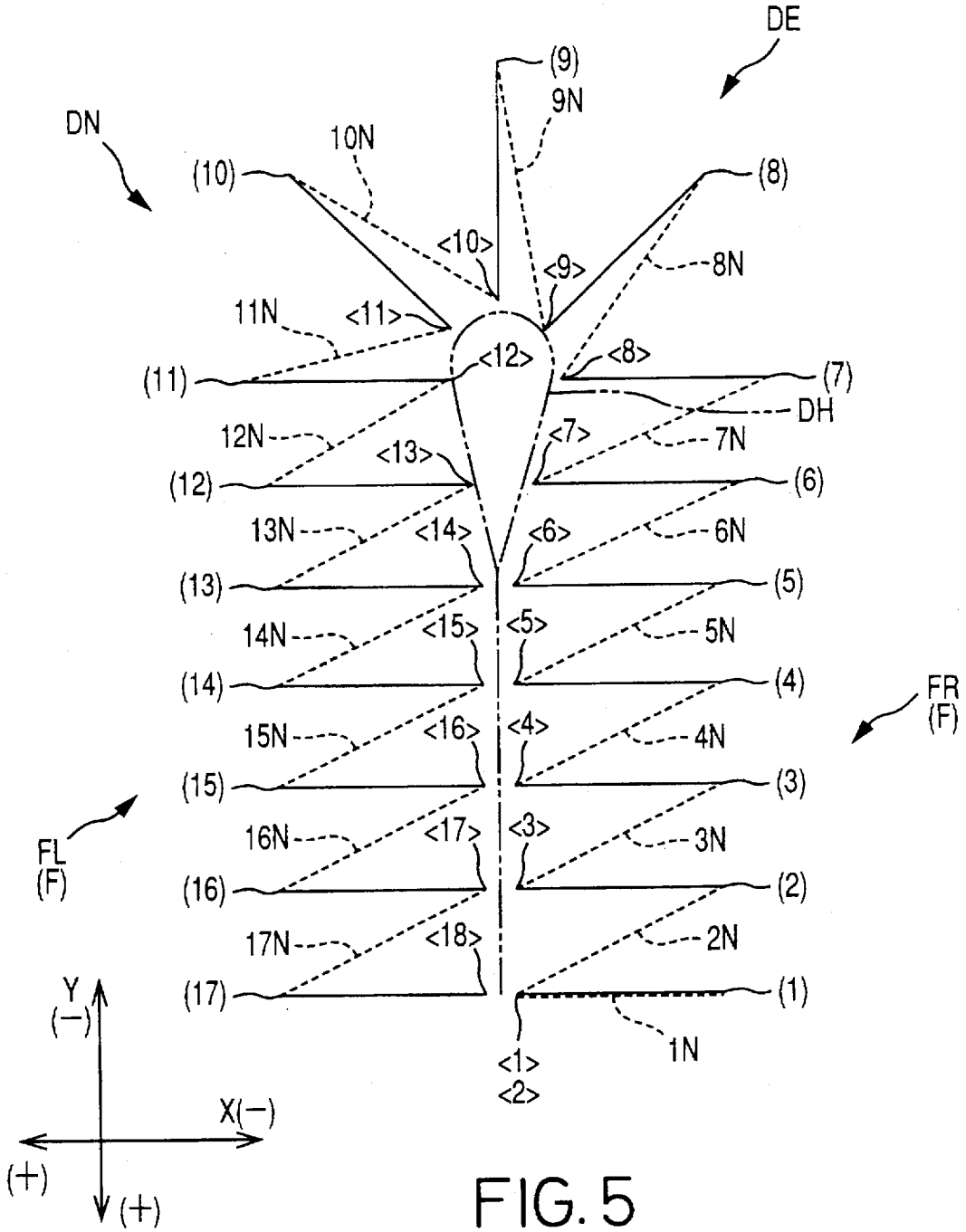
FIG. 5 is a view for explaining stitches formed on a work fabric, to define the foot and eyelet end portions of the eyelet-end buttonhole.

Referring first to FIG. 1, there will be described a buttonhole sewing machine M adapted to stitch an eyelet-end buttonhole or keyhole type buttonhole as indicated generally at DN in FIG. 5. The buttonhole sewing machine M includes a bed 1 having a substantially rectangular box construction, which rests on a machine base 16. On this bed 1, there is fixedly mounted a standard 17 which carries an integrally formed bracket arm 2. The bed 1 movably supports a feeding table 13 for feeding a work fabric. The bracket arm 2 extends over the feeding table 13, and supports a vertically reciprocable needle bar 4 to which a sewing needle 3 is attached.

As described below in detail, a looper base 6 is accommodated in the bed 1. The looper base 6 incorporates a looper device having two loopers 6*a*. The needle bar 4 (sewing needle 3) and the looper device (loopers 6*a*) constitute a major part of stitch-forming instrumentalities for forming zigzag stitches on the work fabric placed on the feeding table 13. As indicated by broken lines in FIG. 5, each zigzag stitch connects an inner stitching position and an outer stitching position. For instance, the second zigzag stitch 2N connects the inner stitching position <2> and the outer stitching position (2). In FIG. 5, <N> represents the inner stitching position while (N) represents the outer stitching position.

Figure 3:
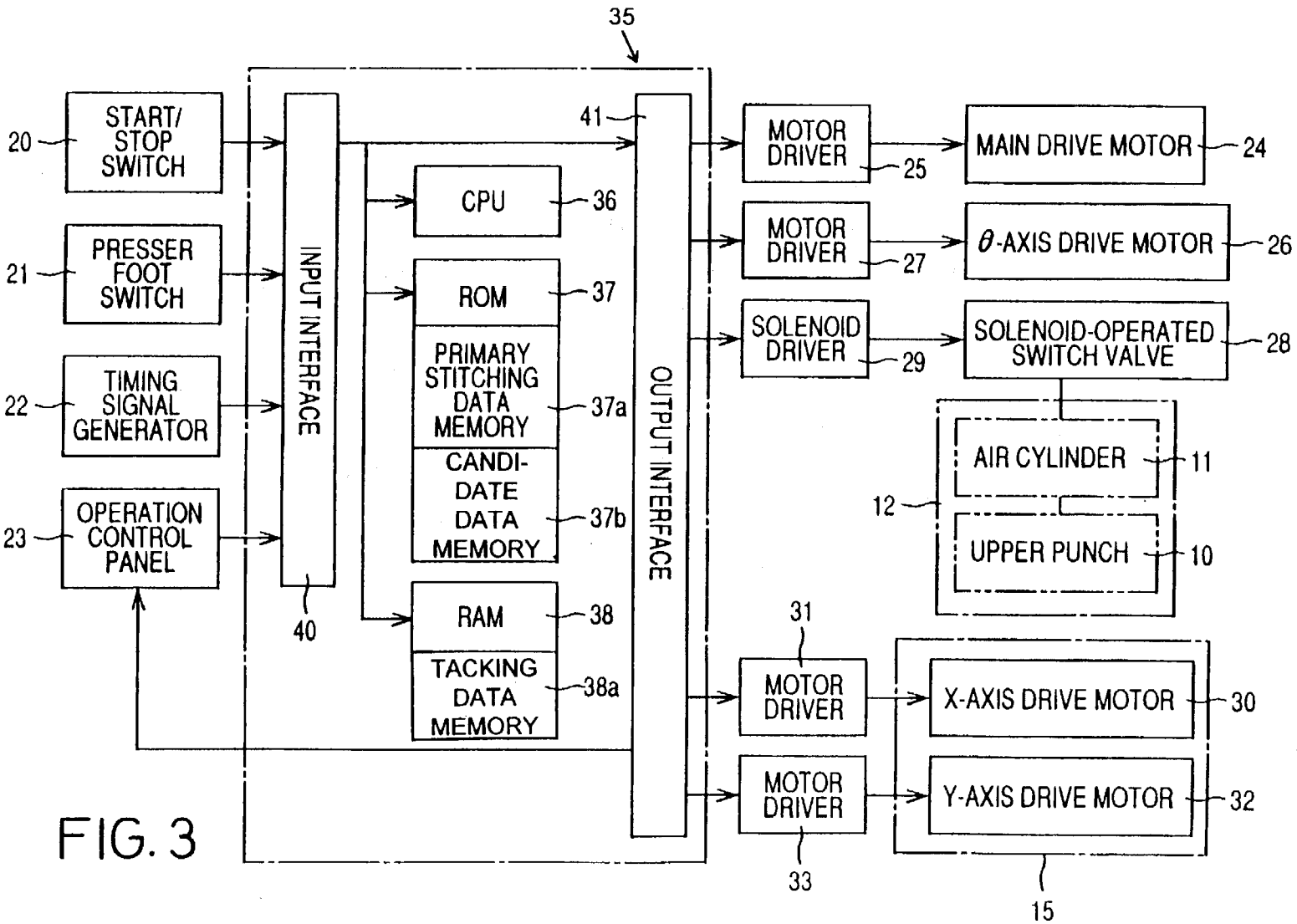
FIG. 3 is a block diagram illustrating a control system of the sewing machine of FIG. 1.

The needle bar 4 or sewing needle 3 and the looper device (loopers 6*a*) are operated by a driving mechanism, in synchronization with each other, to form the zigzag stitches successively. The driving mechanism includes a drive source in the form of a main drive motor 24 (FIG. 3) disposed in the machine base 16, and a main spindle 5 disposed in the standard 17. The machine base 16 carries an operation control panel 23 illustrated in FIG. 6, and a foot-operated START/STOP switch 20 and a presser foot switch 21, which are shown in FIG. 3. The machine base 16 further accommodates a control device 35 also shown in FIG. 3, which is principally constituted by a microcomputer.

The needle bar 4 is vertically reciprocated with the sewing needle 3, by rotation of the main spindle 5 by the main drive motor 24. The rotary motion of the main spindle 5 is transferred to the needle bar 4 through a suitable cam mechanism as well known in the art. The needle bar 4 is adapted to be jogged laterally or sideways by a predetermined distance "L" by a suitable jogging mechanism, such that the lateral jogging movement of the needle bar 4 (sewing needle 3) is synchronized with the vertical reciprocating movement of the same. Described in detail, one full rotation or revolution of the main spindle 5 causes two reciprocating motions of the needle bar 4. The sewing needle 3 is lowered to an inner or left stitching position in the first reciprocating motion, and to an outer or right stitching position in the second reciprocating motion.

The looper base 6 incorporating the two loopers 6*a* (looper device) is disposed in the bed 1 such that the two loopers 6*a* are aligned with the inner and outer stitching positions of the sewing needle 3 indicated above. The rotary motion of the main spindle 5 which is transferred to the needle bar 4 through the cam mechanism is also transferred to the two loopers 6*a* through another cam mechanism, so that the loopers 6*a* are operated in synchronization with the vertical movement of the needle bar 4. The above-indicated driving mechanism for driving the stitch-forming instrumentalities (3, 4, 5, 6*a*) also includes the above-indicated cam mechanisms between the main spindle 5 and the needle bar 4 and the looper device (6*a*).

The needle bar 4 and the looper base 6 are rotated or pivoted as a unit about a vertical axis by a rotating mechanism 8, which includes a θ-axis drive motor 26 and a gear train 7. The θ-axis drive motor 26 is a stepping motor, a rotary motion of which is transferred to the needle bar 4 and the looper base 6 through the gear train 7. The vertical axis or θ-axis is perpendicular to X and Y axes along which the feeding table 13 are fed, as described below.

The bed 1 also accommodates a lower die 9 located behind the looper base 6. An upper punch 10 is disposed above this lower die 9, pivotally about a horizontal axis such that the upper punch 10 is moved toward and away from the lower die 9 upon pivotal movement of the upper punch 10 by an air cylinder 11 (FIG. 3) disposed in the bed 1. The upper punch 10 and the air cylinder 11 constitute a punch mechanism 12 (FIG. 3), which cooperates with the lower die 9 to constitute a cutter device for cutting an opening or aperture in the work fabric. This aperture consists of a generally elongate hole and an eyelet DH as indicated by two-dot chain line in FIG. 5. The elongate hole and the eyelet DH cooperate to form an eyelet-end buttonhole DN, which is worked with stitches. That is, the worked or stitched eyelet-end buttonhole DN includes a foot portion F consisting of a pair of side stitching parts FR, FL, and an eyelet end portion DE formed at one end of the foot portion F. The pair of side stitching parts FR, FL of the foot portion F are spaced apart from each other by the elongate hole, and are connected at their ends by the eyelet end portion DE which defines the eyelet DH. For convenience sake, "DN" represents either the eyelet-end buttonhole as an aperture consisting of the generally elongate hole and the eyelet DH, or the stitched or worked eyelet-end buttonhole whose periphery is defined by zigzag stitches in the foot portion F and the eyelet end portion DE.

Figure 2:
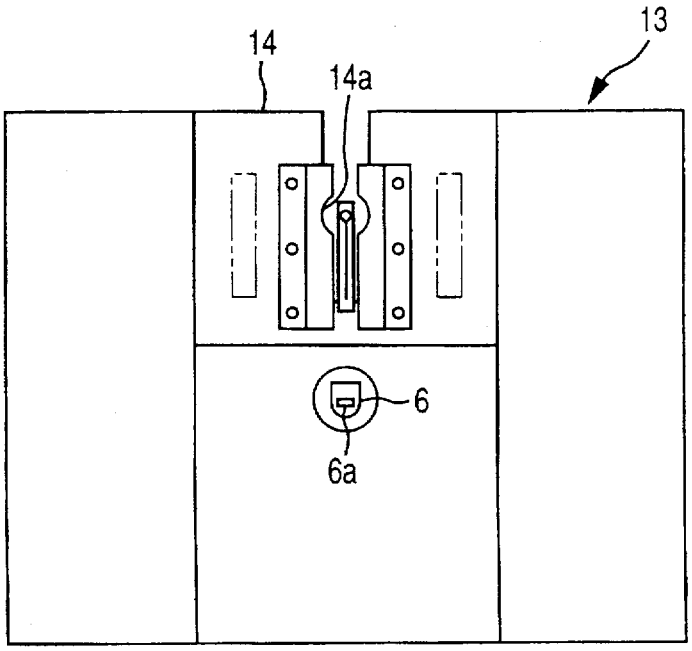
FIG. 2 is a fragmentary plan view of a feeding table of the sewing machine of FIG. 1.

The feeding table 13 movably supported on the bed 1 for feeding movements of the work fabric has a rectangular box construction having a relatively small height dimension. The feeding table 13 has a lower opening corresponding to the looper base 6, and an opening corresponding to the lower die 9. A part of the upper surface of the feeding table 13 is provided by a cloth plate 14 made of a metal and having an aperture 14*a*, as shown in FIG. 2. The feeding table 13 is fed along the mutually perpendicular X and Y axes (in the X-axis and Y-axis directions) by a feeding mechanism 15, which includes an X-axis drive motor 30 and a Y-axis drive motor 32, as indicated in FIG. 3. These drive motors 30, 32 are also stepping motors. The Y axis is parallel to the direction of extension of the pair of side stitching parts FR, FL of the foot portion F of the eyelet-end buttonhole DN, while the X axis is parallel to the direction in which the two side stitching parts FR, FL are spaced apart from each other, namely, perpendicular to the Y axis, as indicated in FIG. 5. As indicated above with respect to the rotating mechanism 8, the X and Y axes are perpendicular to the θ-axis about which the needle bar 4 and the looper base 6 are rotated by the θ-axis drive motor 26. The X-axis movement and the Y-axis movement of the feeding table 13 may be effected independently of each other. The cloth plate 14 is provided with two presser foot members (not shown) disposed on the right and left sides of the aperture 14*a*, for holding the work fabric on the feeding table 13.

Referring to the block diagram of FIG. 3, there will be described a control system for the present buttonhole sewing machine M.

The control system includes a control device 35 which incorporates a microcomputer including a central processing unit (CPU) 36, a read-only memory (ROM) 37 and a random-access memory (RAM) 38. The control device 35 further incorporates an input interface 40 and an output interface 41 which are connected to the microcomputer through a data bus 39. To the input interface 40, there are connected the above-indicated START/STOP switch 20, presser foot switch 21 and operation control panel 23, and a timing signal generator 22. The presser foot switch 21 generates a signal indicative of the operating position of the presser foot members indicated above. The timing signal generator 22 produces a SPINDLE PHASE signal indicative of the angular phase of the main spindle 5.

The control device 35 applies drive signals to driver circuits 25, 27, 29, 31 and 33 through the output interface 41. The driver circuit 25 is connected to the main drive motor 24 for operating the needle bar 4 and the looper device 6*a*. The driver circuit 27 is connected to the θ-axis motor 26 for rotating the needle bar 4 and the looper base 6. The driver circuit 29 is connected to a solenoid-operated switch valve 28 for controlling the air cylinder 11 to actuate the upper punch 10. The driver circuits 31 and 33 are connected to the X-axis drive motor 30 and the Y-axis drive motor 32, respectively. The output interface 41 is also connected to the operation control panel 23 for interactive communication between the control device 35 and the operation control panel 23.

Figures 8, 9:
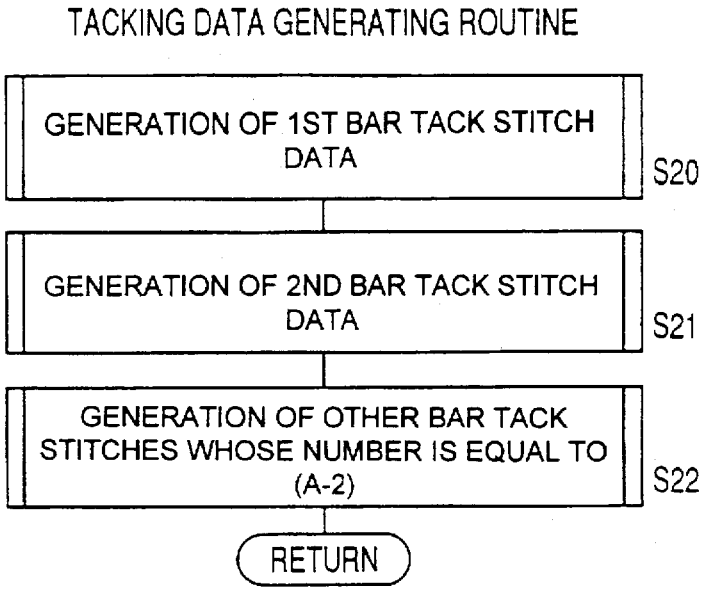
FIG. 8 is a flow chart illustrating a tacking data generating routine executed according to a tacking data generating program also stored in the read-only memory.
FIG. 9 is a view for explaining secondary stitching data in the form of tacking data generated by the routine of FIG. 8 for stitching the bar tack portion of the eyelet-end buttonhole.

The ROM 37 stores a buttonhole stitching control program for executing an eyelet-end buttonhole stitching routine illustrated in the flow chart of FIG. 7, a characteristic data processing program for executing a characteristic data processing routine (not shown) in step S11 of the routine of FIG. 7, and a tacking data generating program for executing a tacking data generating routine illustrated in the flow chart of FIG. 8. The tacking data generating routine of FIG. 8 is also executed in step S11 of the routine of FIG. 7. The ROM 37 includes a primary stitching data memory 37*a* for storing primary stitching data representative of a feeding movement of the feeding table 13 and a rotating movement of the needle bar 4 and looper base 6, for each of the 17 zigzag stitches 1N through 17N which form the foot portion F and the eyelet end portion DE of the eyelet-end buttonhole DN, as shown in FIG. 5. The driving mechanism (5, 24), feeding mechanism (15) and rotating mechanism (8) are controlled according to the primary stitching data to stitch the foot and eyelet end portions F, DE of the eyelet-end buttonhole DN. The primary stitching data consist of 17 sets of data each set indicating the number of operating steps or pulses of the X-axis drive motor 30, the number of operating steps or pulses of the Y-axis drive motor 32, and the number of operating steps or pulses of the θ-axis drive motor 26, as indicated in FIG. 4.

Figure 10:
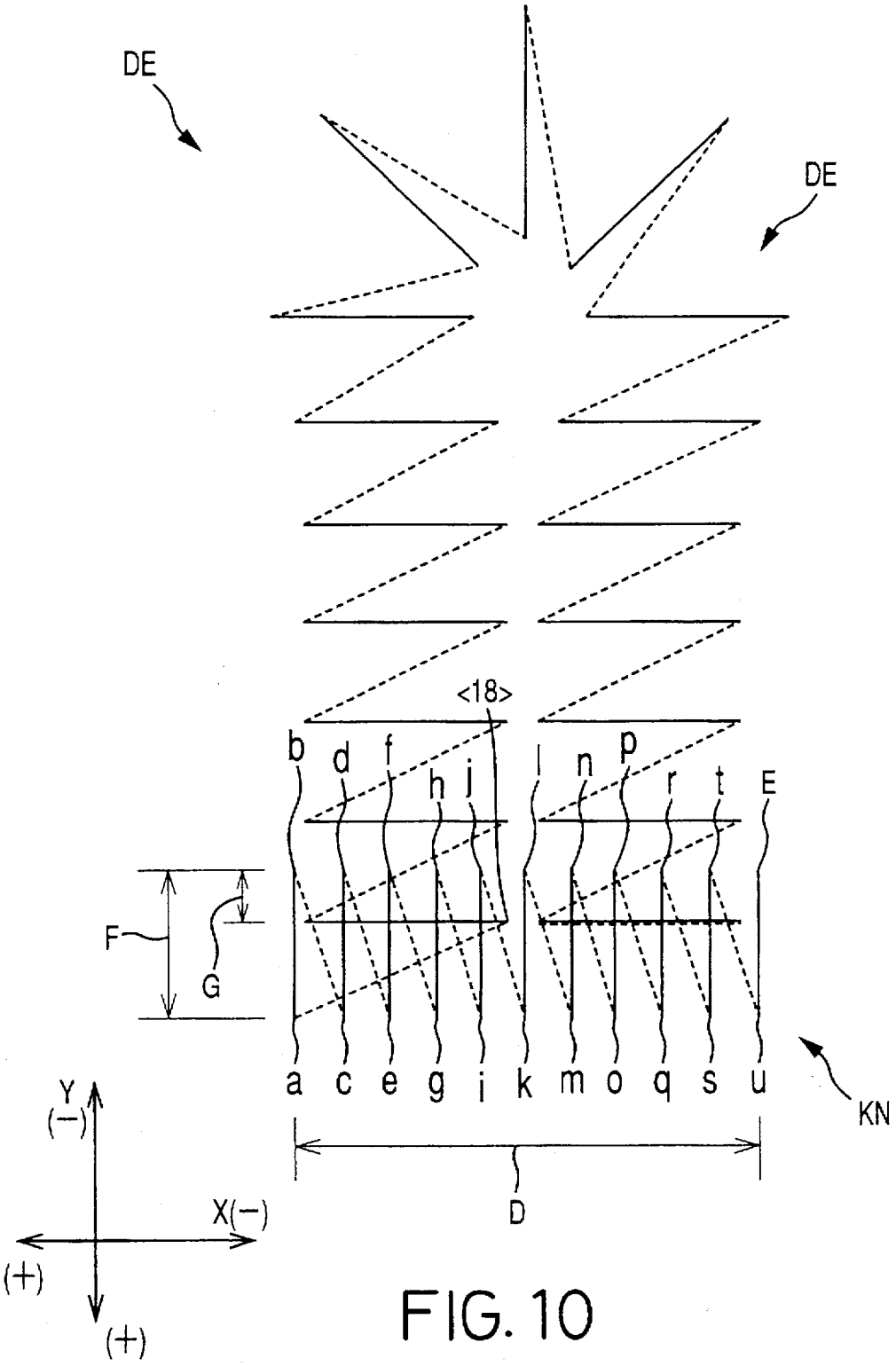
FIG. 10 is a view for explaining bar tack stitches formed according to the tacking data to stitch the bar tack portion such that the bar tack portion partially overlaps the foot portion.

On the other hand, the RAM 38 includes a tacking data memory 38*a* for storing tacking data as secondary stitching data representative of a feeding movement of the feeding table 13 and a rotating movement of the needle bar 4 and looper base 6, for each of the zigzag stitches for forming a bar tack portion KN shown in FIG. 10. The tacking data are generated by the control device 35 in the tacking data generating routine of FIG. 8 according to the tacking data generating program stored in the RON 37. As described below in detail, the tacking data are generated on the basis of desired characteristics of the bar tack portion KN which are specified by the operator of the sewing machine M. When the characteristics of the bar tack portion KN are specified by the operator, candidate data stored in a candidate data memory 37*b* of the ROM 37 may be used, as described below.

As indicated in FIGS. 4 an 5 and described above, the foot portion F and the eyelet end portion DE consist of a total of 17 zigzag stitches 1N through 17N. The first through fifth stitches 1N–5N form the right side stitching part FR, and the sixth through thirteen stitches 6N–13N form the eyelet end portion DE, while the fourteenth through seventeenth stitches 14N–17N form the left side stitching part FL. In FIG. 5, the inner stitching position of each stitch N is indicated by <N>, while the outer stitching position is indicated by (N). In the coordinate system of FIG. 5, the leftward movement of the feeding table 13 is in the positive X direction (+X), and the rightward movement is in the negative X direction (–X). Similarly, the downward movement is in the positive Y direction (+Y), and the upward movement is in the negative Y direction (–Y). The positive Y direction (+Y) is indicated by arrow in FIG. 1.

On the operation control panel 23, there are provided an array of legends representative of seven items of characteristics of the foot portion F, eyelet end portion DE and bar tack portion KN: FOOT LENGTH; STITCHING PITCH; NUMBER OF EYELET-END STITCHES; TACKING LENGTH; NUMBER OF BAR TACK STITCHES; TACKING WIDTH; and TACK OVERLAP. These items of characteristics have the following meanings:

FOOT LENGTH:

Length of the foot portion F in the Y-axis direction

STITCHING PITCH:

Stitching pitch of the foot portion F in the Y-axis direction

NUMBER OF EYELET-END STITCHES:

Number of stitches in the eyelet end portion DE

TACKING LENGTH:

Length D of the bar tack portion KN in the X-axis direction

NUMBER OF BAR TACK STITCHES:

Number A of stitches in the bar tack portion KN

TACKING WIDTH:

Width F of the bar tack portion KN in the Y-axis direction

TACK OVERLAP:

Amount G of overlap in the Y-axis direction of the bar tack portion KN with respect to the foot portion F The operation control panel 23 provides a 3-digit LED display 23*a*, a selector key 23*b*, an increment key 23*c*, a decrement key 23*d*, an enter 23*e*, and a cancel key 23*f*. Indicator lights 23*g* are provided for the respective items of characteristics. In the example of FIG. 6, the indicator light 23*g* adjacent to the legend FOOT LENGTH is illuminated, indicating that the length of the foot portion F of the eyelet-end buttonhole DN can be specified or entered by using the increment and decrement keys 23*c*, 23*d* and the enter key 23*e*. That is, a numerical value displayed on the display 23*a* can be incremented or decremented by the increment or decrement key 23*c*, 23*d*. When the enter key 23*e* is pressed, the numerical value being displayed on the display 23*a* is entered or specified as the effective value indicative of a characteristic (e.g., foot length) of the foot portion F, eyelet end portion DE or bar tack portion KN. When the cancel key 23*f* is pressed, the displayed numerical value is zeroed. Each time the selector key 23*b* is pressed, the item of characteristic that can be specified or entered by the operator is changed, with the corresponding indicator light 23*g* being illuminated.

For the control device 35 to automatically generate the tacking data for the bar tack portion KN as described below, the operator must specify the seven items of characteristics represented by the legends provided on the operation control panel 23. The first three items, FOOT LENGTH, STITCHING PITCH and NUMBER OF EYELET-END STITCHES determine the foot and eyelet-end portions F, DE of a specific eyelet-end buttonhole, while the other four items determine the characteristics of the bar tack portion KN. The primary stitching data memory 37*a* stores a batch of primary stitching data consisting of two or more sets of stitching data corresponding to different eyelet-end buttonholes having different sizes.

The control device 35 may be adapted to select the set of primary stitching data depending upon the numerical values entered through the operation control panel 23 for the first three characteristic items of the foot and eyelet-end portions F, DE as described above. Alternatively, the control device 35 may be adapted to select the set of primary stitching data on the basis of a buttonhole identification number given to each eyelet-end buttonhole. The buttonhole identification number may be entered through the selector key 23*b*, for example.

After the eyelet-end buttonhole to be stitched is selected or specified, the fourth characteristic items of the bar tack portion KN must be entered or specified also through the operation control panel 23. That is, desired numerical values should be entered for the items TACKING LENGTH, NUMBER OF BAR TACK STITCHES, TACKING WIDTH and TACKING OVERLAP. In other words, the length D, stitch number A, width F and overlap amount G of the bar tack portion KN to be formed at the end of the foot portion F remote from the eyelet end portion DE must be entered through the operation control panel 23 and stored in the RAM 38, so that the control device 35 automatically generates the tacking data for the bar tack portion KN.

When the appropriate set of primary stitching data for the foot and eyelet end portions F, DE is selected by entering the corresponding buttonhole identification number, the characteristics of the bar tack portion KN may be specified by using the candidate data memory 37*b* indicated above with respect to the ROM 37. The candidate data stored in the candidate data memory 37*b* represent different candidate values of each of the four characteristic items, for example, candidate values D1, D2 and D3 of the bar tack length D. The control device 35 may be adapted such that an appropriate one of these three candidate values D1–D3 is displayed on the display 23*a* when the specific buttonhole identification number is entered through the operation control panel 23 by the operator. If the enter key 23*e* is pressed in this condition, the candidate value of the length D is specified as the effective value and stored in the RAM 38. If the operator desires to change this candidate value, the value can be changed by using the increment key 23*c* or decrement key 23*d*, and the changed value can be stored as the effective value by pressing the enter key 23*e*.

After the characteristics of the specific eyelet-end buttonhole DN (including the desired characteristics of the bar tack portion KN) have been specified and stored in the RAM 38, the START/STOP switch 20 is operated to a START position, whereby the eyelet-end buttonhole stitching routine is executed according to the buttonhole stitching control program stared in the ROM 37, as illustrated in the flow chart of FIG. 7.

The eyelet-end buttonhole stitching routine of FIG. 7 is initiated with step S10 in which the foot and eyelet end portions F, DE of the eyelet-end buttonhole DN are stitched according to the primary stitching data retrieved from the primary stitching data memory 37*a* of the ROM 37. That is, the zigzag stitches 1N through 17N are successively formed in this order, to thereby define the right side stitching part FR, eyelet end portion DE and left side stitching part FL, in this order, as shown in FIG. 5.

Then, the control flow goes to step S11 in which the characteristic data of the bar tack portion KN entered through the operation control panel 23 and stored in the RAM 38 are processed according to a suitable characteristic data processing program, and the tacking data generating routine of FIG. 8 is initiated to generate the tacking data as indicated in FIG. 9 for stitching the bar tack portion KN. Described in detail, the tacking data generating routine is initiated with step S20 to generate stitching data for the first bar tack stitch on the basis of the specified characteristics of the bar tack portion KN. Step S20 is followed by step S21 in which stitching data for the second bar tack stitch are generated also on the basis of the specified characteristics of the bar tack portion KN. Then, the control flow goes to step S22 in which stitching data for the third through (A–2)th bar tack stitches are generated. It is noted that "A" represents the total number of stitches of the bar tack portion KN. The stitching data for each of these third and subsequent bar tack stitches are the same as the stitching data for the second stitch, as indicated in FIG. 9. The thus generated tacking data are stored in the tacking data memory 38*a*.

As indicated in FIG. 9, the tacking data thus generated in the tacking data generating routine of FIG. 8 according to the tacking data generating program stored in the ROM 37 include data for operating the θ-axis drive motor 26 to rotate the needle bar 4 and the looper base 6 through 90° so that the stitching direction of the bar tack portion KN is changed 90° with respect to the stitching direction of the left side stitching part FL. The data for operating the θ-axis drive motor 36 are included in the stitching data for the first bar tack stitch. The stitching data for the first bar tack stitch further include data for operating the X-axis and Y-axis drive motors 30, 32 for stitching between a first inner stitching position <18> and a first outer stitching position "a", and also include data for operating the motors 30, 32 for stitching between the first outer stitching position "a" and a second inner stitching position "b". The first inner stitching position <18> is the inner stitching position of the last stitch in the left side stitching part FL. The stitching data for the second bar tack stitch include data for operating the motors 30, 32 for stitching between the second inner stitching position "b" and a second outer stitching position "c", and data for operating the motors 30, 32 for stitching between the second outer stitching position "c" and a third inner stitching position "d". As described above, data for each of the third and subsequent bar tack stitches up to the (A–2)th stitch are the same as the data for the second bar tack stitch. The bar tack portion KN is ended at point E.

In FIG. 9, "L" represents the jogging distance of the sewing needle 3, and "p1" and "p2" represent feed pitches in the X-axis and Y-axis directions, respectively, namely, feeding distances per one operating step or pulse of the X-axis and Y-axis drive motors 30, 32, respectively. Further, "p3" represents an angular pitch about the θ-axis, namely, an angle of rotation per one operating step or pulse of the θ-axis drive motor 26.

Step S22 of the tacking data generating routine of FIG. 8 is followed by step S12 of the eyelet-end buttonhole stitching routine of FIG. 7, in which the bar tack portion KN is stitched according to the tacking data stored in the tacking data memory 38*a*, such that the stitching position is shifted from the position <18> to the end point "E" through the positions "a" through "u", as indicated in FIG. 10. It will be understood that the portion of the control device 35 assigned to execute the tacking data generating routine of FIG. 8 (step S11 of the buttonhole stitching routine of FIG. 7) constitutes a data generating device for generating the tacking data for the bar tack portion KN on the basis of the characteristics of the bar tack portion KN as specified by the machine operator.

The size of the upper punch 10 in the Y-axis direction may be changed depending upon the overlap amount G of the bar tack portion KN.

In the present embodiment, the tacking data for the bar tack portion KN to be formed at the end of the foot portion F remote from the eyelet end portion DE are automatically generated by the control device 35 on the basis of the characteristics of the bar tack portion KN which are specified by the operator through the operation control panel 23 and stored in the RAM 38. Thus, the buttonhole stitching efficiency is significantly improved according to the present arrangement of the eyelet-end buttonhole sewing machine M.

The operation control panel 23 permits the operator to easily specify desired values for the length D, width F, overlap amount G and number A of stitches of the bar tack portion KN of the eyelet-end buttonhole DN. Further, the operator may utilize the candidate data stored in the candidate data memory 37*b*, so that a candidate of the value of each of the above characteristic parameters D, F, G and A is automatically displayed on the display 23*a* when the foot and eyelet end portions F, DE of the eyelet-end buttonhole DN are specified, for example, by entering the buttonhole identification number through the operation control panel 23.

Further, the operator may enter desired numerical values in specifying the characteristics of the eyelet-end buttonhole, in particular, the characteristics of the bar tack portion KN, by using the increment and decrement keys 23*c*, 23*d* and enter key 23*e*. When it is desired to stitch the eyelet-end buttonhole DN without formation of the bar tack portion KN, the cancel key 23*f* may be used to cancel the characteristic data once specified and stored in the RAM 38.

While the present invention has been described above in detail in its presently preferred embodiment, it is to be understood that the present invention is not limited to the details of the illustrated embodiment, but may be embodied with various changes, modifications and improvements, which may occur to those skilled in the art, in the light of the foregoing teachings, without departing from the spirit and scope of the invention defined in the following claims.

In the illustrated embodiment, the characteristics of the bar tack portion KN are specified before the buttonhole stitching routine of FIG. 7 is initiated, and the steps S10, S11 and S12 of the routine of FIG. 7 are implemented continuously. However, the routine of FIG. 7 may be interrupted after step S10, so that the operator may specify the characteristics of the bar tack portion KN after the foot portion F and the eyelet end portion DE have been actually formed and before step S11 is initiated to generate the tacking data. In this case, the operator may terminate the buttonhole stitching operation without forming the bar tack portion KN if desired, by operating a suitable key such as the cancel key 23*f* provided on the operation control panel 23.

What is claimed is:

1. A buttonhole sewing machine for forming on a work fabric zigzag stitches defining an eyelet-end buttonhole including a foot portion and an eyelet end portion formed at one end of said foot portion, each of said zigzag stitches connecting an inner stitching position and an outer stitching position, said buttonhole sewing machine comprising:

stitch-forming instrumentalities including a sewing needle attached to a needle bar and, a looper device disposed in a looper base, said needle and said looper device cooperating to form said zigzag stitches;

a driving mechanism for operating said sewing needle and said looper device in synchronization with each other, to form said zigzag stitches successively;

a feeding table movable with said work fabric in mutually perpendicular X-axis and Y-axis directions;

a feeding mechanism for feeding said feeding table in said Y-axis and X-axis directions independently, when said sewing needle is placed above said work fabric;

a rotating mechanism for rotating said needle bar and said looper base about a e axis intersecting said X- and Y-axis directions;

a control device for controlling said driving mechanism, said feeding mechanism and said rotating mechanism, according to primary stitching data representative of a feeding movement of said feeding table and a rotating movement of said needle bar and said looper base for each of said zigzag stitches in said foot portion and said eyelet-end portion of said eyelet-end buttonhole;

a data input device operable by an operator of the buttonhole sewing machine to specify at least one characteristic of a bar tack portion to be formed at the other end of said foot portion; and a data generating device for generating tacking data as secondary stitching data on the basis of said at least one characteristic specified through said data input device, said tacking data being used to stitch said bar tack portion.

2. A buttonhole sewing machine according to claim 1, wherein said control device includes primary control means for controlling said driving, feeding and rotating mechanisms according to said primary stitching data, to stitch said foot and eyelet-end portions, and secondary control means for controlling said driving, feeding and rotating mechanisms according to said secondary stitching data, to stitch said bar tack portion.

3. A buttonhole sewing machine according to claim 1, wherein said data generating device generates said tacking data such that said bar tack portion is stitched in a direction substantially perpendicular to a direction of stitching of said foot portion.

4. A buttonhole sewing machine according to claim 1, further comprising:

a primary stitching data memory storing a plurality of sets of said primary stitching data representative of respective different eyelet-end buttonholes;

a characteristic data memory storing a plurality of sets of characteristic data indicative of respective candidate values of each of said at least one characteristic of said bar tack portion;

selecting means for selecting one of said sets of the primary stitching data, to stitch a corresponding one of said eyelet-end buttonholes; and candidate determining means for determining one of said candidate values on the basis of the set of characteristic data selected by said selecting means, as a candidate of said characteristic of said bar tack portion suitable for the eyelet-end buttonhole to be stitched.

5. A buttonhole sewing machine according to claim 4, further comprising a display for indicating said one of said candidate values determined by said candidate determining means, and changing means for changing the candidate value indicated on said display.

6. A buttonhole sewing machine according to claim 4, further comprising cancelling means for cancelling the candidate value determined by said candidate determining means.

7. A buttonhole sewing machine according to claim 1, wherein said at least one characteristic of said bar tack portion of said eyelet-end buttonhole includes at least one of: a length of said bar tack portion in said Y-axis direction; number of stitches in said bar tack portion; a width of said bar tack portion in said X-axis direction; and an amount of overlap in said Y-axis direction of said bar tack portion with respect to said foot portion.

8. A buttonhole sewing machine according to claim 1, wherein said data input device includes:

a display capable of displaying a numerical value;

value changing means operable by an operator of the buttonhole sewing machine, for changing the numerical value displayed on said display; and a member operable by the operator to specify the numerical value displayed on said display, as said each characteristic of said bar tacking portion.

9. A recording medium accessible by a computer of a sewing machine for forming on a work fabric zigzag stitches defining an eyelet-end buttonhole including a foot portion and an eyelet end portion at one end of said foot portion, each of said zigzag stitches connecting an inner stitching position and an outer stitching position, said recording medium storing:

a tacking data generating program for generating tacking data usable by said sewing machine for forming zigzag stitches in a bar tack portion of said eyelet-end buttonhole, wherein said bar tack portion is located at the other end of said foot portion, and wherein said bar tack portion is stitched in a direction substantially perpendicular to a direction of stitching of said foot portion, said tacking data generating program being formulated to generate said tacking data on the basis of at least one characteristic of said bar tack portion specified by an operator of the sewing machine.

10. A recording medium accessible by a computer of a sewing machine for forming on a work fabric zigzag stitches defining an eyelet-end buttonhole including a foot portion and an eyelet end portion at one end of said foot portion, each of said zigzag stitches connecting an inner stitching position and an outer stitching position, said recording medium storing:

a tacking data generating program for generating tacking data usable by said sewing machine for forming zigzag stitches in a bar tack portion of said eyelet-end buttonhole, wherein said bar tack portion is located at the other end of said foot portion, and wherein said bar tack portion is stitched in a direction substantially perpendicular to a direction of stitching of said foot portion, said tacking data generating program being formulated to generate said tacking data on the basis of at least one characteristic of said bar tack portion specified by an operator of the sewing program; and a buttonhole stitching control program executed by said computer for operating said sewing machine to form said zigzag stitches in said bar tack portion, according to said tacking data generated according to said tacking data generating program.

11. A recording medium according to claim 10, further storing a characteristic data processing program executed by said computer for processing characteristic data which are entered through a data input device by the operator and which represent said at least one characteristic of said bar tack portion, so that said tacking data are generated according to said tacking data generating program and the characteristic data processed according to said characteristic data processing program.

12. A recording medium accessible by a computer of a sewing machine capable of forming on a work fabric zigzag stitches defining an eyelet-end buttonhole including a foot portion, an eyelet end portion at one end of said foot portion, and a bar tack portion at the other end of said foot portion, said sewing machine comprising (a) stitch-forming instrumentalities including a sewing needle attached to a needle bar, and a looper device disposed in a looper base, said needle and said looper device cooperating to form said zigzag stitches, (b) a driving mechanism for operating said sewing needle and said looper device in synchronization with each other, to successively form said zigzag stitches, (c) a feeding table movable with said work fabric in mutually perpendicular X-axis and Y-axis directions, (d) a feeding mechanism for feeding said feeding table in said X-axis and Y-axis directions independently, when said sewing needle is placed above said work fabric, and (e) a rotating mechanism for rotating said needle bar and said looper base about a θ axis intersecting said X- and Y-axis directions, said recording medium storing:

a buttonhole stitching control program executed by said computer for controlling said driving mechanism, said feeding mechanism and said rotating mechanism, according to primary stitching data representative of a feeding movement of said feeding table and a rotating movement of said needle bar and said looper base for each of said zigzag stitches in said foot portion and said eyelet end portion of said eyelet-end buttonhole, and according to secondary stitching data representative of a feeding movement of said feeding table and a rotating movement of said needle bar and said looper base for each of said zigzag stitches in said bar tack portion of said eyelet-end buttonhole; and a tacking data generating program for generating tacking data as said secondary stitching data for forming said zigzag stitches in said bar tack portion, said tacking data generating program being formulated to generate said tacking data on the basis of at least one characteristic of said bar tack portion specified by an operator of the sewing machine.

13. A recording medium according to claim 12, wherein said foot portion of said eyelet-end buttonhole extends in said Y-axis direction between said eyelet end portion and said bar tack portion, and said tacking data generating program is formulated to generate said tacking data such that said bar tack portion is stitched in a direction which is substantially parallel to said X-axis direction and substantially perpendicular to said Y-axis direction.

14. A recording medium according to claim 13, wherein said tacking data generating program is formulated to generate said tacking data on the basis of at least a dimension of said bar tack portion in said X-axis direction.

* * * * *